US011839830B2

(12) United States Patent
Lin et al.

(10) Patent No.: US 11,839,830 B2
(45) Date of Patent: Dec. 12, 2023

(54) PORTABLE ELECTRIC FOAM MAKER

(71) Applicant: Stallion Sport Limited, Kowloon (HK)

(72) Inventors: Joseph Lin, Carson, CA (US); Hon Chiu Chan, Kowloon (HK); Ping Wai Lee, N.T. (HK)

(73) Assignee: Stallion Sport Limited, Hong Kong (HK)

( * ) Notice: Subject to any disclaimer, the term of this patent is extended or adjusted under 35 U.S.C. 154(b) by 43 days.

(21) Appl. No.: 17/581,905

(22) Filed: Jan. 22, 2022

(65) Prior Publication Data

US 2023/0233956 A1 Jul. 27, 2023

(51) Int. Cl.
*A63H 33/28* (2006.01)

(52) U.S. Cl.
CPC ..... *A63H 33/28* (2013.01)

(58) Field of Classification Search
CPC ..... A63H 33/28
See application file for complete search history.

(56) References Cited

U.S. PATENT DOCUMENTS 3,559,741 A * 2/1971 Levy ..... A62C 3/0207 239/265.43
3,563,418 A * 2/1971 Hahn ..... A47L 11/4094 261/DIG. 26
3,801,015 A * 4/1974 Hayes ..... B05B 9/007 261/DIG. 26
3,913,260 A * 10/1975 Corbett ..... B62J 50/40 446/16
3,985,271 A * 10/1976 Gardner ..... B05B 11/0059 222/211
4,027,789 A * 6/1977 Dickey ..... B05B 11/043 222/211
4,030,665 A * 6/1977 Koyama ..... B05B 7/0025 239/602
4,165,834 A * 8/1979 Pitchon ..... A01B 69/022 239/10
4,901,925 A * 2/1990 Blake, III ..... B05B 7/0037 239/371
4,995,844 A * 2/1991 McNett ..... A63H 33/28 446/15
5,269,715 A * 12/1993 Silveria ..... A63H 33/28 446/16
6,109,359 A * 8/2000 Ballard ..... A62C 5/02 169/44
6,237,898 B1 5/2001 Lafont
(Continued)

*Primary Examiner* — Eugene L Kim
*Assistant Examiner* — Matthew B Stanczak
(74) *Attorney, Agent, or Firm* — Raymond Sun

(57) ABSTRACT

A foam maker has a bucket and a lid. The bucket has an outlet port provided in one of its walls, and a delivery tube connected to the outlet port. The lid includes a lid base and a lid top. The lid base has a frame and a compartment that receives a fan, a motor coupled to the fan, and a fluid inlet port through which foam solution and water can be introduced. The lid top has a water/foam inlet opening that is aligned with the fluid inlet port, and an air inlet port that is positioned adjacent the fan. An air tube is disposed inside the bucket, and has a first end connected to the lid base and communicating with the fan, and an opposite second end having an open distal end that is immersed inside foam solution. The air tube further includes an air chamber positioned adjacent the open distal end.

10 Claims, 6 Drawing Sheets

(56) References Cited

U.S. PATENT DOCUMENTS 6,276,459 B1 * 8/2001 Herrick ..... A62C 5/02 169/14
6,276,613 B1 * 8/2001 Kramer ..... B01F 25/45241 134/102.2
6,651,908 B1 * 11/2003 Borglum ..... B05B 7/0037 239/311
6,663,464 B2 12/2003 Payne et al.
6,991,041 B2 * 1/2006 Laskaris ..... A62C 5/02 239/428
7,669,738 B1 * 3/2010 Byers ..... B67D 1/0431 280/47.11
7,883,649 B2 * 2/2011 Guerra ..... G06Q 30/0222 264/50
7,919,026 B2 * 4/2011 Guerra ..... A63H 33/28 264/50
9,283,493 B1 * 3/2016 Bernard ..... A63H 33/28
9,980,615 B1 * 5/2018 Maercovich ..... A47K 5/1211
10,099,078 B1 * 10/2018 Blanchat ..... B05B 7/0491
10,369,489 B2 * 8/2019 McCurley ..... A63H 33/28
11,173,330 B2 * 11/2021 Park ..... B01F 23/20
11,517,527 B2 * 12/2022 Smith ..... A61B 17/12186
2003/0164340 A1 * 9/2003 LeJeune ..... B03D 1/1462 210/776
2004/0088894 A1 * 5/2004 Haughton ..... G09F 13/24 40/406
2004/0094228 A1 * 5/2004 Nadel ..... A63H 33/28 141/98
2004/0155058 A1 * 8/2004 Dunham ..... F41B 11/68 222/79
2005/0257317 A1 * 11/2005 Guerra ..... A63H 33/28 446/16
2007/0040048 A1 * 2/2007 Poizot ..... B05B 11/1023 222/464.2
2008/0061166 A1 * 3/2008 Jacques ..... B05B 9/0816 239/373
2008/0272148 A1 * 11/2008 Malik ..... B01F 25/23 222/137
2009/0193695 A1 * 8/2009 Guerra ..... G09F 19/00 40/212
2009/0200340 A1 * 8/2009 Ophardt ..... F04C 11/001 222/190
2011/0306265 A1 12/2011 Mor
2012/0091228 A1 * 4/2012 Tseng ..... B05B 9/0822 239/311
2014/0034679 A1 * 2/2014 Fitzpatrick ..... B05B 15/58 222/137
2015/0343322 A1 * 12/2015 Beavers ..... B01F 35/32025 446/15
2018/0153353 A1 * 6/2018 Takagi ..... A47K 5/14
2019/0125137 A1 * 5/2019 Takagi ..... A45D 44/00
2019/0159636 A1 * 5/2019 Lo ..... A47K 5/1208
2019/0314734 A1 * 10/2019 Cayton ..... A63H 33/28
2020/0100628 A1 * 4/2020 Wang ..... A47K 5/1217
2020/0197828 A1 6/2020 Yang

* cited by examiner

PORTABLE ELECTRIC FOAM MAKER

BACKGROUND OF THE INVENTION

1. Field of the Invention

The present invention relates to a portable electric foam maker that can generate and disperse a large quantity of foam bubbles.

2. Description of the Prior Art

There are a wide variety of outdoor toys that involve water. Some of the most popular outdoor toys are foam makers that generate and disperse foam bubbles.

Conventional foam makers are usually large and bulky, and require connections to water hoses to supply water. There are also foam makers that need to be plugged into a power outlet, and so there are risks of electrical shock. There is often a trade-off between size and foam production, as the smaller foam makers do not produce the volume and quality of foam that is often desired.

Thus, there remains a need for a foam maker that can produce a large volume of high-quality foam bubbles, yet is compact, safe and convenient to use.

SUMMARY OF THE DISCLOSURE

It is an object of the present invention to provide a foam maker that can produce a large volume of high-quality foam bubbles, yet is compact, safe and convenient to use.

In order to accomplish the objects of the present invention, there is provided a foam maker having a bucket and a lid. The bucket has at least one wall that defines an interior for holding foam solution, an outlet port provided in one of the at least one wall, and a delivery tube connected to the outlet port. The lid includes a lid base and a lid top. The lid base has a frame and a compartment that receives a fan, a motor coupled to the fan, and a fluid inlet port through which foam solution and water can be introduced. The lid top has a water/foam inlet opening that is aligned with the fluid inlet port, a sealing cap removably secured to the water/foam inlet opening, and an air inlet port that is positioned adjacent the fan. An air tube is disposed inside the bucket, and has a first end connected to the lid base and communicating with the fan, and an opposite second end having an open distal end that is immersed inside foam solution. The air tube further includes an air chamber positioned adjacent the open distal end.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a portable electric foam maker 100 that can effectively generate many foam bubbles.

Figure 1:
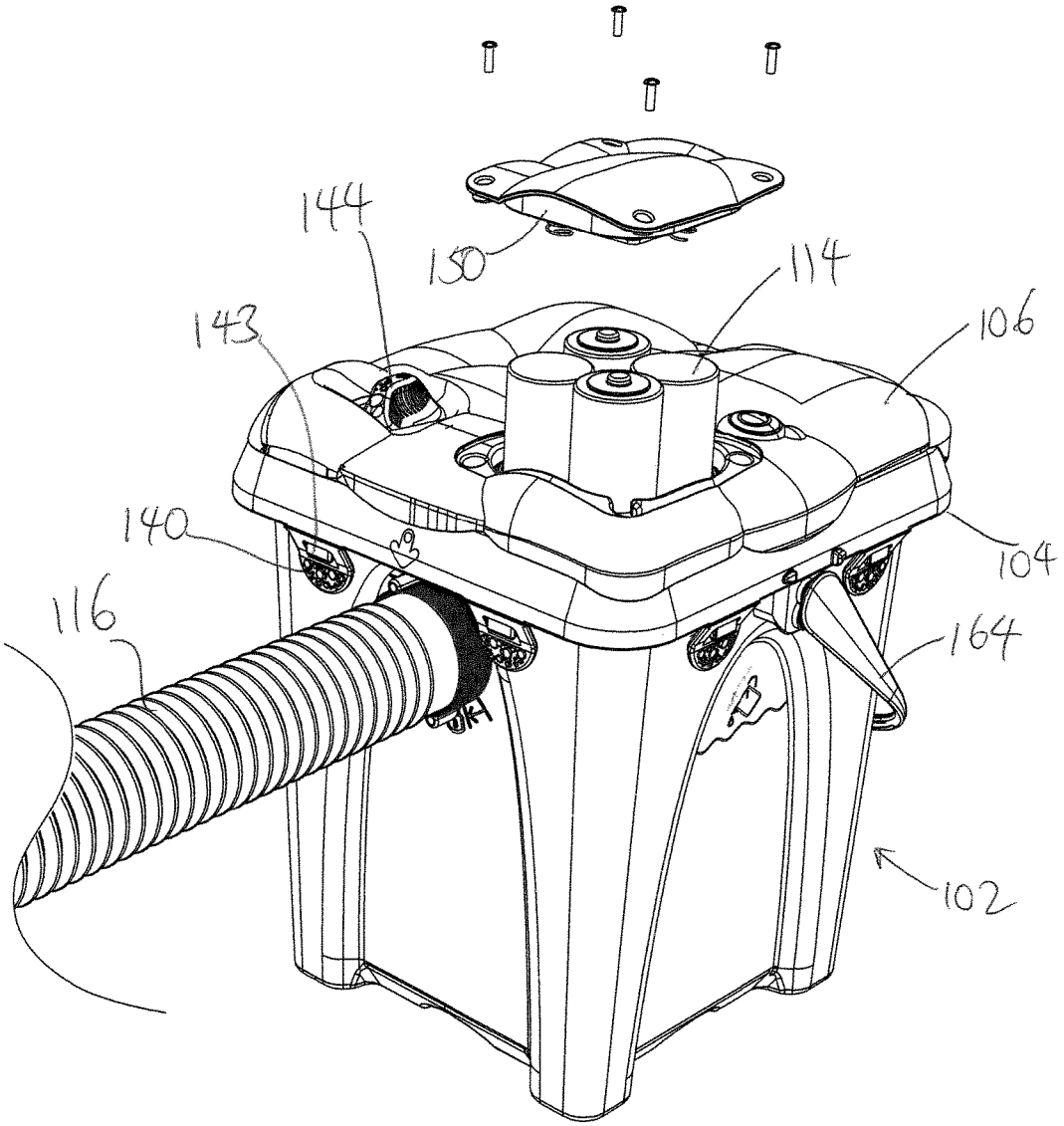
FIG. 1 is an exploded perspective view of a portable electric foam maker according to one embodiment of the present invention.
Figure 2:
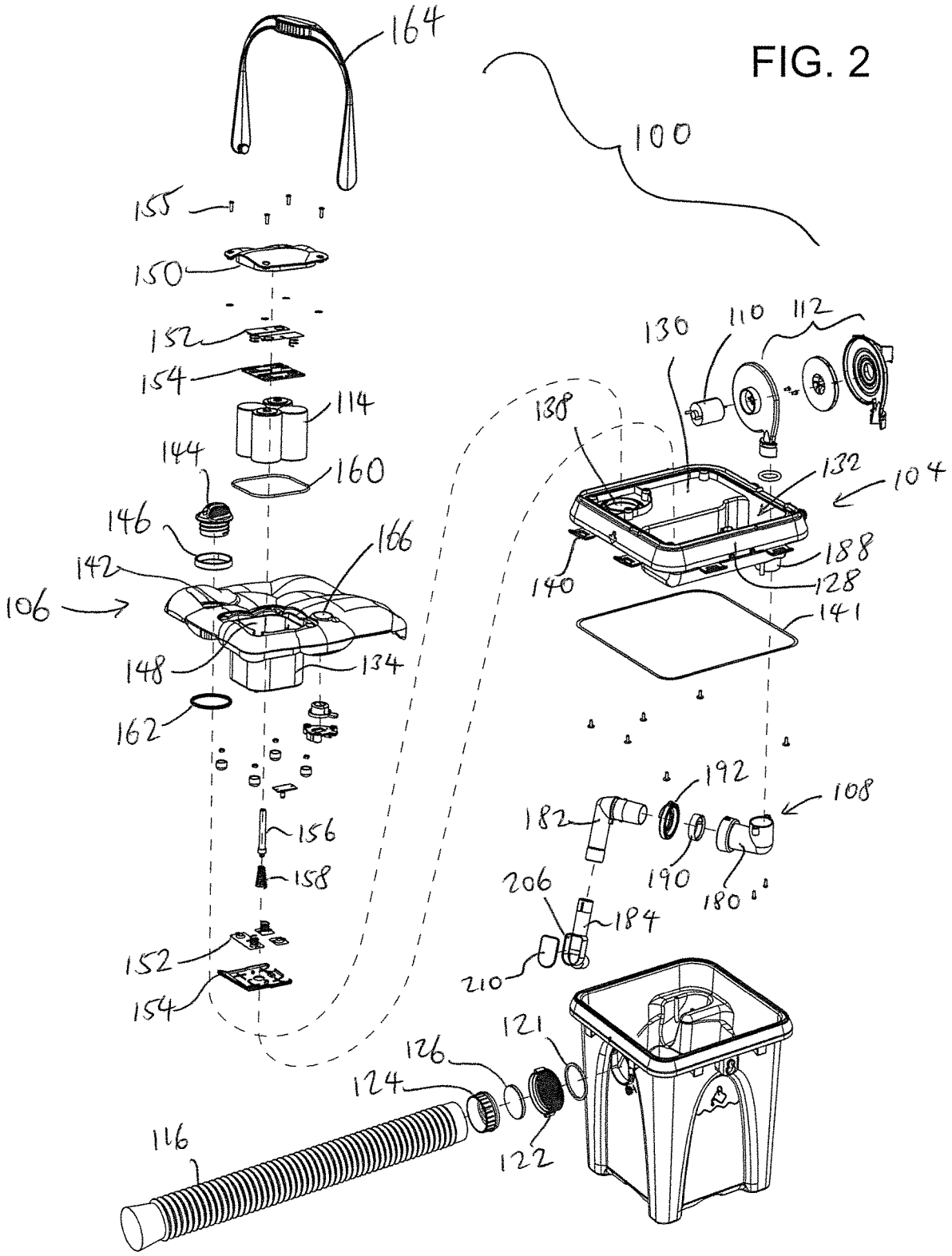
FIG. 2 is an exploded perspective view of the foam maker of FIG. 1.
Figure 3:
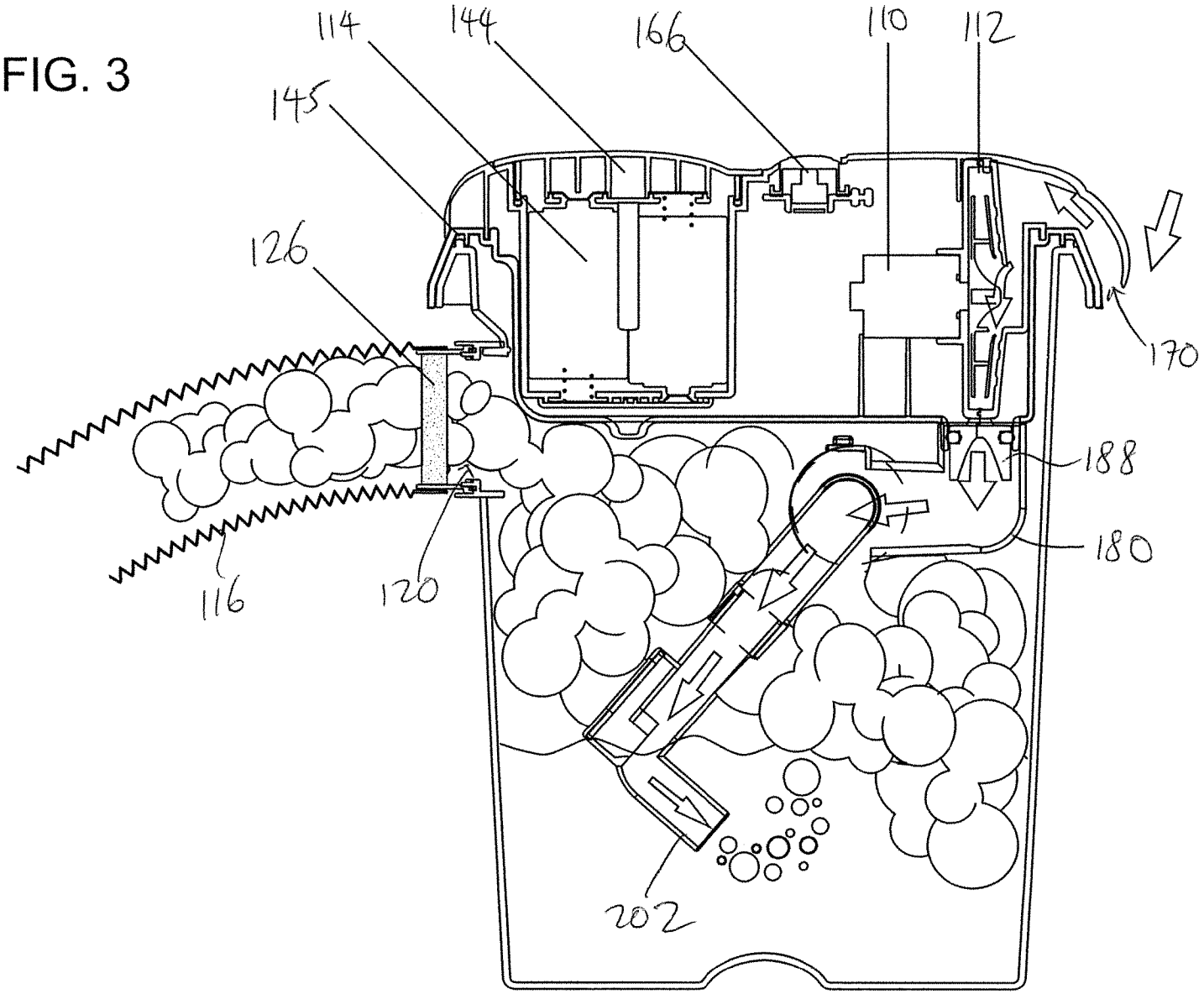
FIG. 3 is a cross-sectional view of the foam maker of FIG. 1.

Referring to FIGS. 1-3, the foam maker 100 has a bucket 102 and a lid that includes a lid base 104 and a lid top 106. An air tube 108 extends from the lid base 104 into the bucket 102. A foam delivery tube 116 extends from a side wall of the bucket 102 to deliver foam bubbles. The lid (combined lid base 104 and lid top 106) houses a motor 110, a fan 112 coupled to the motor 110, and a power supply (e.g., batteries 114) that operate to generate foam. The motor 110 and the fan 112 generate air that is pumped via the air tube 108 into a foam solution inside the bucket 102, and foam is produced that is then expelled through the delivery tube 116.

The bucket 102 is shown in the FIGS. as having a four-sided configuration with four walls, but can be embodied in any desired configuration (e.g., circular or rectangular, among others). An outlet port 120 is provided in one of the walls of the bucket 102, and a tube connector 122 is secured to the outlet port 120 to connect to a filter holder 124. A water sealing ring 121 is provided between the tube connector 122 and the outer peripheral edge of the outlet port 120 to provide an effective seal. A filter 126 is provided inside the filter holder 124. The delivery tube 116 is connected to the filter holder 124, and can be an extendable tube whose length can be varied.

Figure 4:
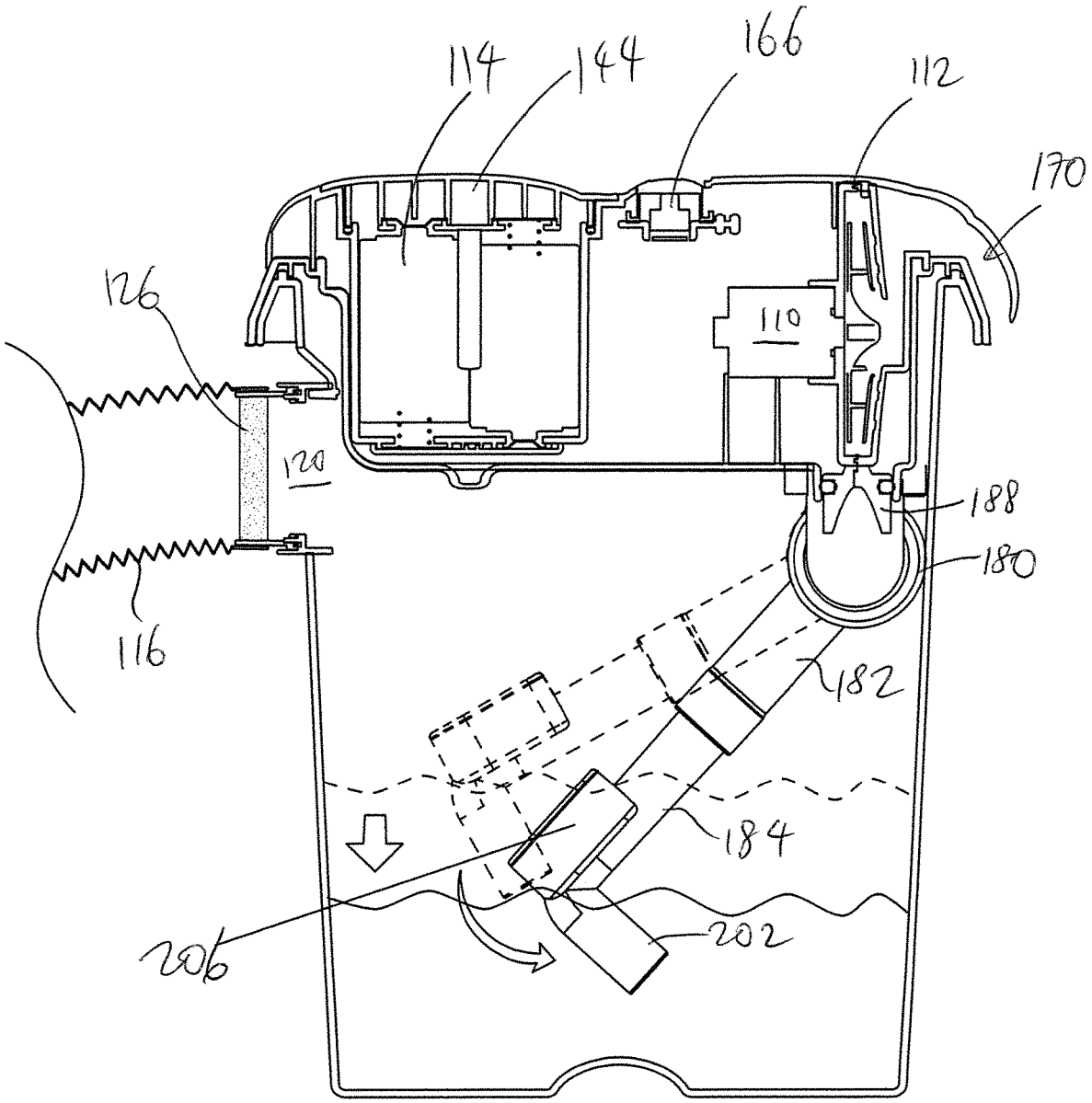
FIG. 4 is a cross-sectional view of the foam maker of FIG. 1 showing how the air chamber adjusts the floatation of the air tube.

Referring to FIGS. 2-4, the lid base 104 has the same configuration as the bucket 102 so that it can be fitted on top of the bucket 102. In this embodiment, the lid base 104 has a frame 128 with four sides. Approximately half of the interior space defined by the four-sided frame 128 is covered by a platform 130, and the other half of the interior space defines a large compartment 132. The fan 112 and the motor 110 are positioned at one enlarged end of the compartment 132, and the other part of the compartment 132 is adapted to receive a battery housing 134 that extends from the lid top 106. A fluid inlet port 138 is provided in the platform 130 and is adapted to allow foam solution to be introduced therethrough. Locking tabs 140 are provided in spaced-apart manner about the periphery of the frame 128, and are adapted to engage lock pins 143 that are provided in spaced-apart manner along the upper rim of the bucket 102. The underside of the frame 128 has a groove 145 that receives the upper peripheral edge of the bucket 102. A sealing ring 141 is provided between the bottom of the lid base 104 and the upper peripheral edge of the bucket 102 to provide an effective seal.

The lid top 106 has a water/foam inlet opening 142 that is aligned with the inlet port 138, and is adapted to receive a sealing cap 144. A sealing ring 146 can be provided around the threaded stem of the sealing cap 144 to provide a more effective seal. A battery compartment opening 148 is also provided on the lid top 106, and the battery housing 134 extends downwardly from the opening 148. The batteries 114 are retained in the battery housing 134, and a battery lid 150 seals the battery housing 134. A battery housing sealing ring 160 cooperates with the battery lid 150 to provide a better seal. In addition, a water seal ring 162 seals the lid top 106 and the lid base 104 at the fluid inlet port 138. Battery contact plates 152 and battery plate holders 154 are provided to deliver the power from the batteries 114 to the motor 110 through power wires. A battery lid push pin 156 extends from the base of the battery housing 134, and works with a spring 158 to bias the battery lid 150 when the screws 155 are loosened so as to facilitate easy removal. An air inlet port 170 is provided on the lid top 106 at a position adjacent the fan 112. See FIG. 3.

A handle 164 can be secured to the peripheral walls of the bucket 102. An on/off switch 166 can be provided on top of the lid top 106 to turn the motor 110 on and off.

Figure 5:
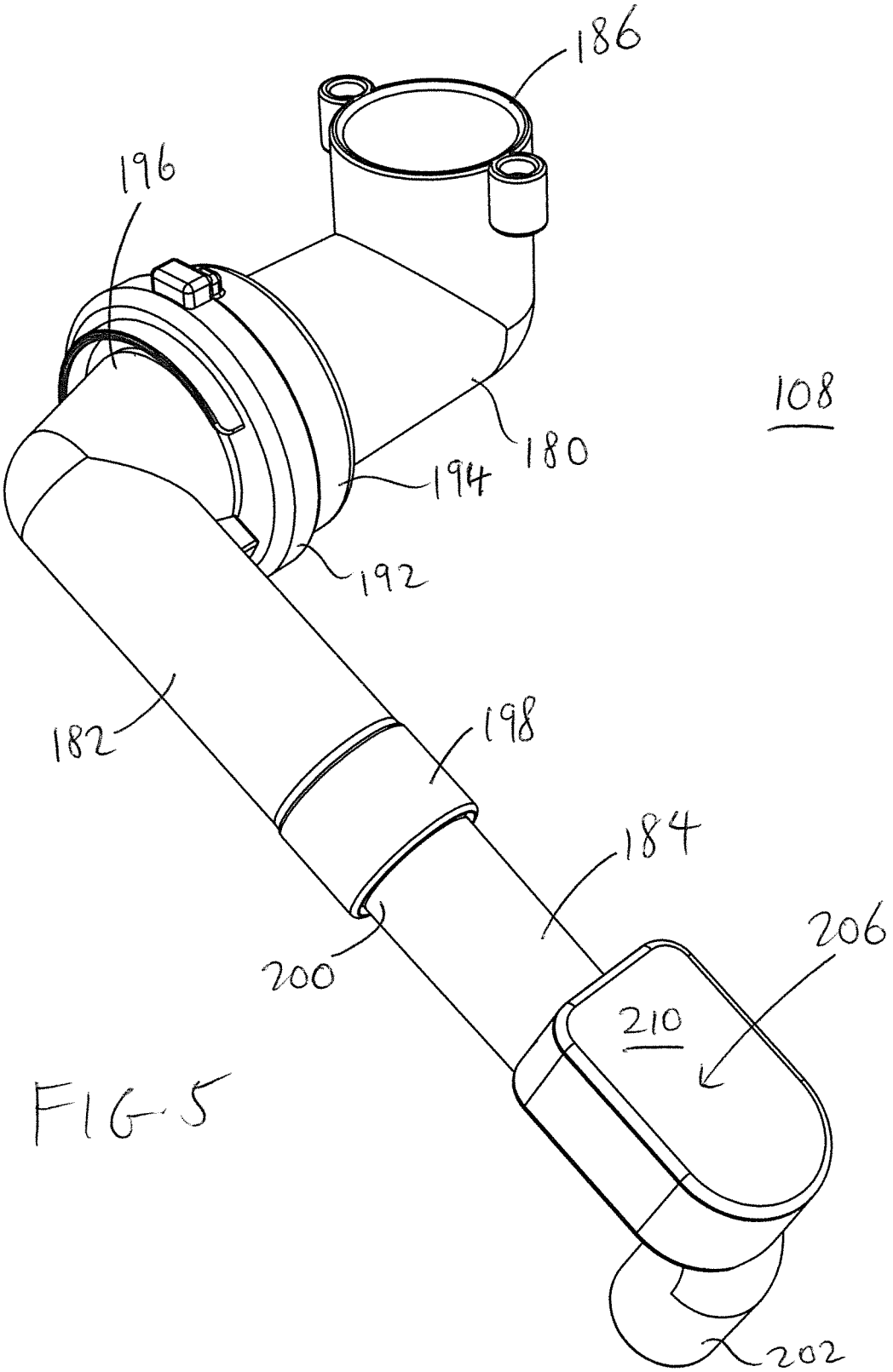
FIG. 5 is a perspective view of the air tube.
Figure 6:
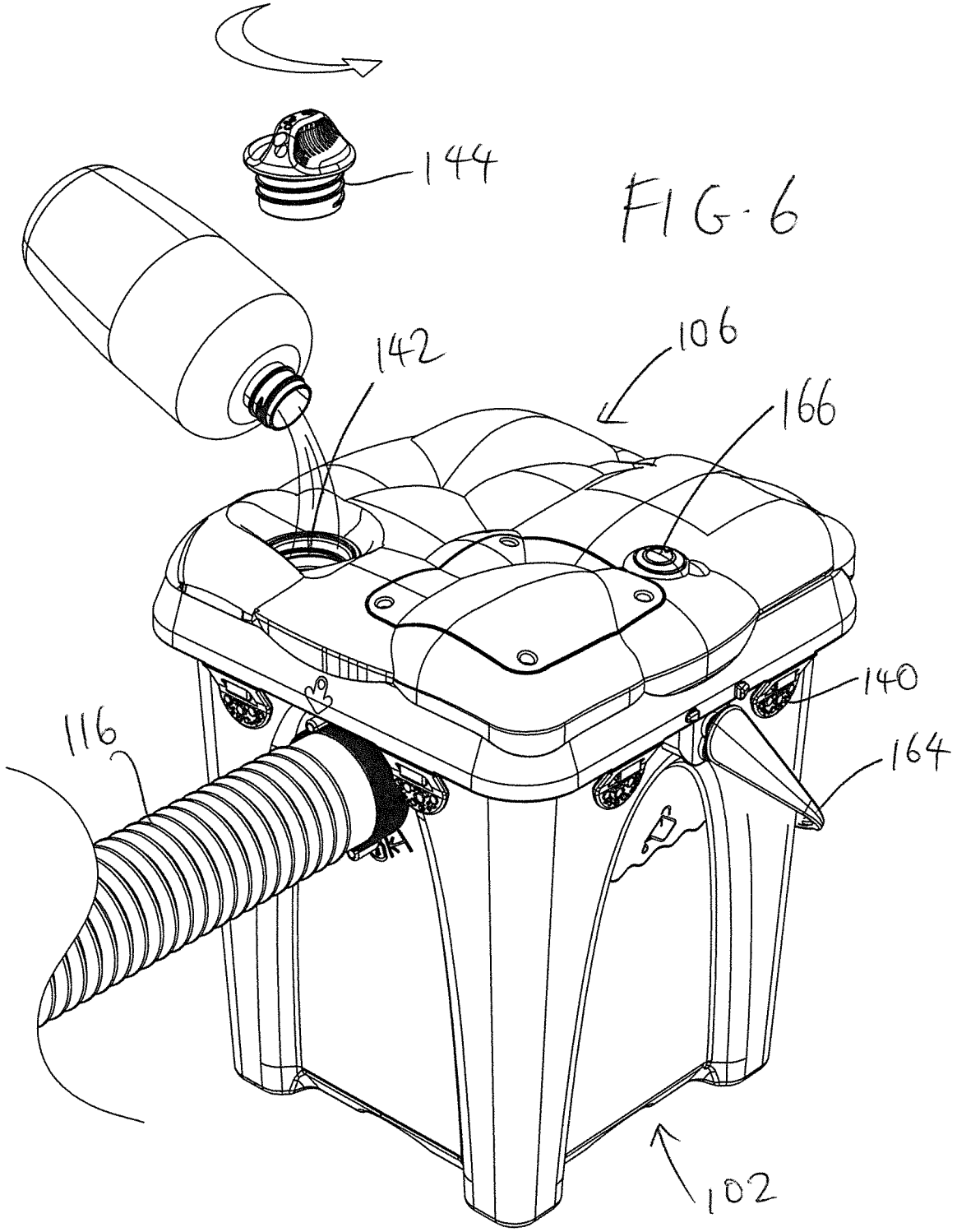
FIG. 6 is a perspective view of the foam maker of FIG. 1 showing part of its operation.

Referring to FIGS. 2 and 5, the air tube 108 has a fixed L-shaped connector tube 180, a movable L-shaped central tube 182, and a movable L-shaped end tube 184. A proximal end 186 of the connector tube 180 is adapted to be secured to a tubular extension 188 that is provided at the base of the lid base 104 under the fan 112 so that the tubular extension 188 is inserted into the lumen of the proximal end 186 to create a communicating air channel. Two connecting rings 190 and 192 provide a moving joint that functions to connect the distal end 194 of the L-shaped connector tube 180 with the proximal end 196 of the L-shaped central tube 182 in a manner that allows the central tube 182 to move with respect to the connector tube 180. The distal end 198 of the central tube 182 is connected to the proximal end 200 of the end tube 184. The proximal end 200 of the end tube 184 can have a smaller diameter than the distal end 198 of the central tube 182 so that the end tube 184 can be inserted into the lumen of the distal end 198. The distal end 202 of the end tube 184 is opened so that the air that is delivered by the fan 112 through the air tube 108 can exit the distal end 202 of the end tube 184.

An air chamber 206 is provided on the end tube 184. The air chamber is hollow inside and is sealed with a cover 210, which traps air inside and keeps the distal end 202 always floating on the top level of the foam solution. In such case, the air being pumped into the foam solution will always encounter minimum water pressure. Thus, the objective of this moving air tube 108 is to make sure that air can be pumped out into the foam solution at the lowest water pressure level, and that battery consumption can be reduced. Since the air chamber 206 is always floating on the top level of the foam solution, the distal end 202 of the end tube 184 will always be slightly immersed in the foam solution. This is best illustrated in FIG. 4. The connector tube 180 remains fixed with respect to the base of the lid base 104, but the central tube 182 can be move with respect to the connector tube 180 as the water level of the foam solution fluctuates to float the air chamber 206.

In addition, the end tube 184 is designed to have a smaller cross-sectional diameter than the central tube 182 so as to increase the air flow speed to generate more foam.

The operation of the foam maker 100 is described in connection with FIGS. 1-6. First, the lid base 104 is secured to the top of the bucket 102 with the locking tabs 140. Second, the screws 155 are loosened and the battery lid 150 is removed, and batteries 114 are inserted into the battery housing 134, and then the battery lid 150 is closed and the screws 155 are tightened. Third, the delivery tube 116 is connected to the bucket 102 by holding and twisting the tube connector 122 to the outlet port 120. Fourth, the cap 144 is unscrewed, and then foam solution and water are poured through the inlet opening 142 and the inlet port 138 into the bucket 102. As shown in FIG. 3, the foam solution should not fill the entire bucket 102, but should only fill a certain depth of the bucket 102. The cap 144 is then screwed back into the inlet opening 142, and then the on/off switch 166 can be pressed to turn on the motor 110.

Next, the motor 110 will rotate the fan 112 to draw ambient air through the air inlet port 170 into the fan 112, where the air is then delivered through the tubular extension 188 into the air tube 108. The air is then dispelled through the opened distal end 202 of the end tube 184 into the foam solution. The air tube 108 is sized and configured (with the L-shaped tubes 180, central tube 182 and end tube 184) so that the distal end 202 can be immersed inside the foam solution, with the air chamber 206 floating on the fluid level of the foam solution. As the air is forced into the foam solution, foam bubbles are created inside the bucket 102, and directed towards the outlet port 120. The filter 126 provides a resistance to the foam bubbles. The pressure inside the bucket 102 increases, which compress the foam bubbles to a finer form before leaving the bucket 102. The foam bubbles then squeeze through the filter 126 and then expelled via the delivery tube 116.

Thus, the present invention provides a foam maker 100 that is simple in construction, yet can effectively generate a large volume of foam bubbles that are finer in texture than conventional foam bubbles. It can be conveniently and quickly set up for use, and no power plugs are needed, so that it can be entirely portable and moved around. The foam maker 100 has a compact size that is lower cost to manufacture, and is safer for use.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A foam maker, comprising:

a bucket having at least one wall that defines an interior for holding foam solution, the bucket having an outlet port provided in one of the at least one wall, and a delivery tube connected to the outlet port;

a lid that includes a lid base and a lid top;

wherein the lid base has a frame and a compartment that receives a fan, a motor coupled to the fan, and a fluid inlet port through which foam solution and water can be introduced;

wherein the lid top has a water/foam inlet opening that is aligned with the fluid inlet port, a sealing cap removably secured to the water/foam inlet opening, and an air inlet port that is positioned adjacent the fan; and an air tube that is positioned inside the interior, and having a first end that is connected to the lid base and communicating with the fan, and an opposite second end having an open distal end that is immersed inside water and foam solution, the air tube further including an air chamber positioned adjacent the open distal end.

2. The foam maker of claim 1, wherein a battery housing extends from the lid top, and locking mechanisms are provided along the frame and are adapted to engage corresponding locking mechanisms that are provided on the bucket.

3. The foam maker of claim 2, wherein a battery compartment opening is also provided on the lid top, and the battery housing extends downwardly from the battery compartment opening.

4. The foam maker of claim 1, wherein the air tube further includes a fixed connector tube, a movable central tube, and a movable end tube, wherein the first end is a proximal end of the connector tube, and the opposite second end is a distal end of the end tube, with the air chamber positioned along the end tube at a distance from the opposite second end.

5. The foam maker of claim 4, wherein a tubular extension is provided at the lid base under the fan, and the proximal end of the connector tube is secured to a tubular extension.

6. The foam maker of claim 4, wherein at least one connecting ring connects the connector tube and the central tube in a manner that allows the central tube to move with respect to the connector tube, and wherein the central tube has a distal end that is connected to a proximal end of the end tube.

7. The foam maker of claim 6, wherein the proximal end of the end tube has a smaller diameter than the distal end of the central tube.

8. The foam maker of claim 4, wherein the water and foam solution has a water level, and wherein the connector tube remains fixed with respect to the lid base, but the central tube can be move with respect to the connector tube as water level of the water and foam solution fluctuates to float the air chamber.

9. The foam maker of claim 1, wherein the water and foam solution has a surface, and wherein the air chamber is always floating on the surface of the water and foam solution.

10. The foam maker of claim 1, wherein the air chamber is hollow inside and is sealed with a cover.

* * * * *